US005593466A

United States Patent [19]

Tack et al.

[11] Patent Number: 5,593,466

[45] Date of Patent: Jan. 14, 1997

[54] OIL AND FUEL OIL COMPOSITIONS

[75] Inventors: Robert D. Tack, Oxford; Kenneth Lewtas, Wantage, both of United Kingdom

[73] Assignee: Exxon Chemical Patents Inc, Linden, N.J.

[21] Appl. No.: 531,800

[22] Filed: Sep. 21, 1995

Related U.S. Application Data

[63] Continuation of Ser. No. 235,111, Apr. 28, 1994, abandoned, which is a continuation of Ser. No. 891,522, Jun. 1, 1992, abandoned, which is a continuation of Ser. No. 516,149, Apr. 30, 1990, abandoned, which is a continuation of Ser. No. 405,712, Sep. 11, 1989, abandoned, which is a continuation of Ser. No. 271,103, Nov. 14, 1988, abandoned, which is a continuation of Ser. No. 905,286, Sep. 8, 1986, abandoned.

[30] Foreign Application Priority Data

Sep. 6, 1985 [GB] United Kingdom ..... 8522185

[51] Int. Cl.[6] ..... C10L 1/18

[52] U.S. Cl. ..... 44/398

[58] Field of Search ..... 44/393, 389, 394, 44/398; 252/56 S

[56] References Cited

U.S. PATENT DOCUMENTS

| | | | |
|---|---|---|---|
| 3,280,027 | 10/1966 | Pierre | 252/56 R |
| 3,390,083 | 6/1968 | Lion | 252/56 R |
| 3,762,888 | 10/1973 | Kober et al. | 44/393 |
| 3,997,455 | 12/1976 | Sayles . | |
| 4,004,255 | 8/1977 | Von Zalm | 252/56 R |
| 4,042,515 | 8/1977 | Van Zalm . | |
| 4,108,612 | 8/1978 | Rossi et al. . | |
| 4,153,422 | 5/1979 | Wisotsky | 44/62 |
| 4,153,423 | 5/1979 | Wisotsky | 44/62 |
| 4,153,424 | 5/1979 | Wisotsky | 44/62 |
| 4,211,534 | 7/1980 | Feldman | 44/62 |
| 4,332,689 | 6/1982 | Tanizaki et al. . | |
| 4,375,973 | 3/1983 | Rossi et al. | 44/62 |
| 4,517,105 | 5/1985 | Laemmle et al. | 252/56 R |
| 4,634,550 | 1/1987 | Feldman et al. | 252/56 R |

FOREIGN PATENT DOCUMENTS

| | | |
|---|---|---|
| 0085803 | 8/1983 | European Pat. Off. . |
| 0155807 | 9/1985 | European Pat. Off. . |
| 0225688 | 6/1987 | European Pat. Off. . |
| 0282342 | 9/1988 | European Pat. Off. . |
| 0308176 | 3/1989 | European Pat. Off. . |
| 1914559 | 10/1969 | Germany . |
| 52072063 | 10/1975 | Japan . |
| 56050995 | 10/1979 | Japan . |
| 0683465 | 11/1952 | United Kingdom . |
| 0706742 | 4/1954 | United Kingdom . |
| 0760994 | 11/1956 | United Kingdom . |
| 0866498 | 4/1961 | United Kingdom . |
| 0903701 | 8/1962 | United Kingdom . |
| 0961395 | 6/1964 | United Kingdom . |
| 1124437 | 8/1968 | United Kingdom . |
| 1244506 | 9/1971 | United Kingdom . |
| 1437132 | 5/1976 | United Kingdom . |
| 1542295 | 3/1979 | United Kingdom . |
| 2023645 | 1/1980 | United Kingdom . |

OTHER PUBLICATIONS

Journal of Institute of Petroleum "New Laboratory Test for Predicting Low–Temperature Operability of Diesel Fuels," vol. 52, #510 Jun. 1966, pp.178–185.

*Primary Examiner*—Margaret Medley
*Attorney, Agent, or Firm*—John J. Mahon

[57] ABSTRACT

Crude oils, lubricating oils or fuel oils have their flow point improved by adding to the crude oil, lubricating oil or fuel oil a minor proportion by weight of a polymer containing the repeating units:

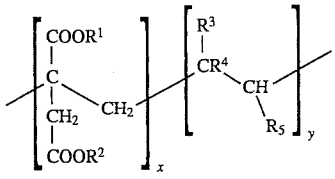

(I) (II)

or

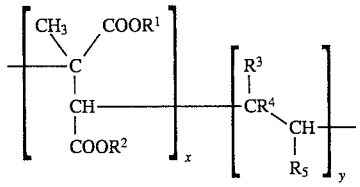

(III) (II)

where x is an integer and y is 0 or an integer and wherein in the total polymer x+y is at least two.

3 Claims, No Drawings

OIL AND FUEL OIL COMPOSITIONS

This application is a continuation under 37 C.F.R. 1.62 of Ser. No. 235,111, filed Apr. 28, 1994, now abandoned, which is a continuation under 37 C.F.R. 1.62 of Ser. No. 891,522, filed Jun. 1, 1992, now abandoned, which is a continuation under 37 C.F.R. 1.60 of Ser. No. 516,149, filed Apr. 30, 1990, now abandoned which is continuation under 37 C.F.R. 1.60 of Ser. No. 405,712, filed Sep. 11, 1989, now abandoned, which is a continuation under 37 C.F.R. 1.60 of Ser. No. 271,103, filed Nov. 14, 1988, now abandoned, which is a continuation under 37 C.F.R. 1.60 of Ser. No. 905,286, filed Sep. 8, 1986, now abandoned.

This invention relates to oil and fuel oil compositions to which a flow improver has been added.

When oils and fuel oils are subjected to low ambient temperatures especially in Northern European countries wax will separate out and impair the flow properties unless a cold flow improver is added. The effectiveness of such additives can be measured by tests such as the CFPPT and SCT and the depression of Cloud Point and Wax Appearance Point can also be ascertained.

We have now discovered certain flow improvers which are effective in improving the cold flow properties of an oil (crude or lubricating) and fuel oils such as residual fuel middle distillate fuels and jet fuel or as a dewaxing acid in lubricating oil and which can be tailored to suit the particular oil or fuel oil concerned.

According to this invention a crude oil, lubricating oil or fuel oil composition comprises a major proportion by weight of a crude oil, lubricating oil or fuel oil and a minor proportion by weight of a polymer containing the units:

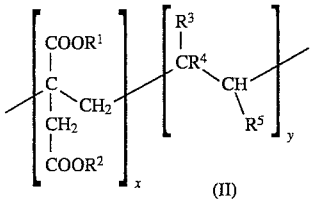

(I) (II)

or

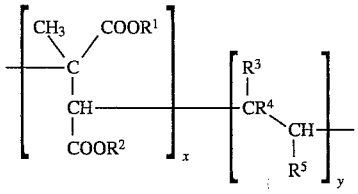

(III) (II)

where x is an integer and y is 0 or an integer and wherein in the total polymer x+y is at least two and the ratio of units (II) to units (I) is between 0 and 2,the ratio of units (II) to (III) is between 0 and 2 and wherein:

$R^1$ and $R^2$, are the same or different, are $C_{10}$ to $C_{30}$ alkyl, $R^3$ is H, —OO C $R^6$, $C_1$ to $C_{30}$ alkyl —COO $R^6$, —$OR^6$, an aryl or alkaryl group or halogen, $R^4$ is H or methyl, $R^5$ is H, $C_1$ to $C_{30}$ alkyl, or —$COOR^6$, $R^6$ is $C_1$ to $C_{22}$ alkyl and provided each of the groups $R^1$, $R^2$, $R^3$, $R^4$, $R^5$, and $R^6$ can be inertly substituted if desired.

This invention also includes the use of such polymers as flow improvers in a crude oil, a lubricating oil or a fuel oil or as a dewaxing aid in a lubricating oil.

Thus, these polymers are either homopolymers of a dialkyl itaconate or citraconate or copolymers of a dialkyl itaconate or citraconate with an aliphatic olefin, a vinyl ether, a vinyl ester of an alkanoic acid, an alkyl ester of an unsaturated acid, an aromatic olefin, a vinyl halide or a dialkyl fumarate or maleate.

The groups $R^1$ and $R^2$ which can be the same or different are $C_{10}$ to $C_{30}$ alkyl groups, and these are preferably straight chain although they can be branched. If branched it is preferred that the branch be a single methyl in the 1 or 2 position. Examples of such groups are decyl, dodecyl, hexadecyl and eicosyl. Each of the groups $R^1$ and $R^2$ may be a single $C_{1O}$ to $C_{30}$ alkyl group or they may be mixtures of alkyl groups. It has been found that mixtures of $C_{12}$ to $C_{16}$ alkyl groups are particularly suitable when the polymer is to be used as a flow improver in middle distillate fuel oils. Likewise, suitable chain lengths are $C_{16}$ to $C_{22}$ for use of the polymer in heavy fuel oils and crude oils and $C_{10}$ to $C_{18}$ for use of the polymer in lubricating oils. These preferred chain lengths are applicable both for homopolymers and for copolymers of dialkyl itaconates or dialkyl citraconates.

When copolymers of dialkyl itaconates or dialkyl citraconates are used y is an integer. The comonomer, that is the compound of the formula:

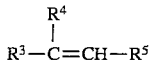

[Unit (II)]

where $R^3$, $R^4$ and $R^5$ are as defined above, can be one or more of a variety of compounds and in all cases mixtures of compounds having this formula can be used.

When the comonomer is an aliphatic olefin $R^3$ and $R^5$ are hydrogen or identical or non-identical $C_1$ to $C_{30}$ alkyl groups, preferably n-alkyl groups. Thus, when $R^3$, $R^4$ and $R^5$ are all hydrogen, the olefin is ethylene, and when $R^3$ is methyl, $R^4$ and $R^5$ are hydrogen, the olefin is n-propylene. When $R^3$ is an alkyl group it is preferred that $R^4$ and $R^5$ are hydrogen. Examples of other suitable olefins are butene-1, butene-2,isobutylene, pentene-1,hexene-1,tetradecene-1, hexadecene-1 and octadecene -1 and mixtures thereof.

Other suitable comonomers are vinyl esters o; alkyl substituted vinyl esters of $C_2$ to $C_{31}$ alkanoic acids, i.e. for vinyl esters when $R^3$ is $R^6$ COO—, $R^4$ is H and $R^5$ is H, and for alkyl substituted vinyl esters when $R^3$ is $R^6$ COO— and $R^4$ is methyl and/or $R^5$ is $C_1$ to $C_{30}$ alkyl. Non-substituted vinyl esters are preferred and suitable examples are vinyl acetate, vinyl propionate, vinyl butyrate, vinyl decanoate, vinyl hexadecanoate and vinyl stearate.

Another class of comonomers are the alkyl esters of unsaturated acids, i.e. when $R^3$ is $R^6$ OOC— and $R^5$ is H or $C_1$ to $C_{30}$ alkyl. When $R^4$ and $R^5$ are hydrogen these comonomers are alkyl esters of acrylic acid. When $R^4$ is methyl the comonomers are esters of methacrylic acid or $C_1$ to $C_{3O}$ alkyl substituted methacrylic acid. Suitable examples of alkyl esters of acrylic acid are methyl acrylate, n-hexyl acrylate, n-decyl acrylate, n-hexadecyl acrylate, n-octadecyl acrylate, and 2-methyl hexadecyl acrylate, whilst suitable examples of alkyl esters of methacrylic acid are propyl methacrylate, n-butyl methacrylate, n-octyl methacrylate, n tetradecyl methacrylate, n-hexadecyl methacrylate and n octadecyl methacrylate. Other examples are the corresponding esters where $R^5$ is alkyl, e.g. methyl, ethyl, n-hexyl, n-decyl, n tetradecyl and n-hexadecyl.

Another suitable class of comonomers is when both $R^3$ and $R^5$ are $R^6$OOC— i.e. when they are $C_1$ to $C_{22}$ dialkyl fumarates or maleates and the alkyl groups may be n-alkyl or branched alkyl e.g. n-octyl, n-decyl, n-tetradecyl, n-hexadecyl or n-octadecyl.

Other examples of comonomer are when $R^3$ is an aryl group. When $R^4$ and $R^5$ are hydrogen and $R^3$ is phenyl the comonomer is styrene and when one of $R^4$ and $R^5$ is methyl the comonomer is a methyl styrene, e.g. α-methyl styrene. Another example when $R^3$ is aryl is vinyl naphthalene. Other suitable examples when $R^3$ is alkaryl are for example substituted styrenes such as vinyl toluene, or 4-methyl styrene.

Another suitable co-monomer is when $R^3$ is halogen, e.g. chlorine, such as vinyl chloride ($R^4$ and $R^5$ hydrogen).

In all cases it is to be understood that some or all of the groups $R^1$, $R^2$, $R^3$, $R^4$, $R^5$ and $R^6$ can be inertly substituted, for example, by one or more halogen atoms, for instance, chlorine or fluorine. Thus, for example, the comonomer could be vinyl trichloroacetate. Alternatively, the substituent could be an alkyl group, e.g. methyl.

The ratio of units (II) to units (I) has to be between 0 (when the polymer is an itaconate or citraconate homopolymer) and 2 (when the polymer is a copolymer) but in practice the ratio for the copolymer will usually be between 0.5 and 1.5, for example, about one.

For both homopolymers and copolymers the molecular weight of polymer will usually be between 1000 and 500,000, for example, between 2300 and 200,000.

Usually the copolymer will consist of only units (I) and (II) or units (II) and (III), but other units are not excluded. However, in practice, it is desirable that the weight percentage of units (I) and (II) or of units (II) and (III) in the copolymer is at least 80% and preferably at least 90%.

The homopolymers and copolymers are generally prepared by polymerising the monomers in a solution of a hydrocarbon solvent such as heptane, benzene, cyclohexane, or white oil, at a temperature generally in the range of from 20° C. to 150° C. and usually promoted with a peroxide or azo type catalyst such as benzoyl peroxide or azodiisobutyronitrile under a blanket of an inert gas such as nitrogen or carbon dioxide in order to exclude oxygen. The polymer may be prepared under pressure in an autoclave or by refluxing.

When copolymers are to be prepared the polymerisation reaction mixture should preferably contain 0 to 2 moles of comonomer (e.g. vinyl acetate) per mole of dialkyl itaconate or dialkyl citraconate.

The copolymers are suitable for use as flow improvers or dewaxing aids in crude oils i.e. the oil as obtained from drilling and before refining. They are also suitable for use in lubricating oils, as flow improvers, pour point depressants or dewaxing aids, both mineral and synthetic. The lubricating oil may be animal, vegetable or mineral oil, for example, petroleum oil fractions ranging from naphthas or spindle oil to SAE 30, 40 or 50 lubricating oil grades, castor oil, fish oils or oxidised mineral oil.

The final lubricating oil may contain other additives according to the particular use for the oil. For example, viscosity index improvers such as ethylene-propylene copolymers may be present as may succinic acid based dispersants, metal containing dispersant additives and the well known zinc dialkyl-dithiophosphate antiwear additives.

The flow improvers are also suitable for use in fuel oils. These fuel oils can be the middle distillate fuel oils, e.g. a diesel fuel, aviation fuel, kerosene, fuel oil, jet fuel, heating oil etc. Generally, suitable distillate fuels are those boiling in the range of 120° to 500° C. (ASTM D1160), preferably those boiling in the range 150° to 400° C., for example, those having a relatively high final boiling point (FBP) of above 360° C. A representative heating oil specification calls for a 10 percent distillation point no higher than about 226° C. a 50 percent point no higher than about 272° C. and a 90 percent point of at least 282° C. and no higher than about 338° C. to 343° C., although some specifications set the 90 percent point as high as 357° C. Heating oils are preferably made of a blend of virgin distillate, e.g. gas oil, naphtha, etc. and cracked distillates, e.g. catalytic cycle stock. A representative specification for a diesel fuel includes a minimum flash point of 38° C. and a 90 percent distillation point between 282° C. and 338° C. (See ASTM Designations D-396 and D-975).

Improved results are often achieved when the fuel compositions of this invention incorporate other additives known for improving the cold flow properties of distillate fuels generally. Examples of these other additives are the polyoxyalkylene esters, ethers, ester/ethers amide/esters and mixtures thereof, particularly those containing at least one, preferably at least two $C_{10}$ to $C_{30}$ linear saturated alkyl groups of a polyoxyalkylene glycol group of molecular weight 100 to 5,000 preferably 200 to 5,000, the alkyl group in said polyoxyalkylene glycol containing from 1 to 4 carbon atoms. European Patent Publication 0,061,895 A2 describe some of these additives.

The preferred esters, ethers or ester/ethers may be structurally depicted by the formula:

$$R—O—(A)—O—R$$

where R and $R^1$ are the same or different and may be i) n-alkyl ii) $\text{n-alkyl-C}(=\text{O})-$ iii) $\text{n-alkyl-O}-\text{C}(=\text{O})-(\text{CH}_2)_n-$ iv) $\text{n-alkyl-O}-\text{C}(=\text{O})(\text{CH}_2)_n-\text{C}(=\text{O})-$ the alkyl group being linear and saturated and containing 10 to 30 carbon atoms, and A represents the polyoxyalkylene segment of the glycol in which the alkylene group has 1 to 4 carbon atoms, such as polyoxymethylene, polyoxyethylene or polyoxytrimethylene moiety which is substantially linear; some degree of branching with lower alkyl side chains (such as in polyoxypropylene glycol) may be tolerated but it is preferred the glycol should be substantially linear.

Suitable glycols generally are the substantially linear polyethylene glycols (PEG) and polypropylene glycols (PPG) having a molecular weight of about 100 to 5,000, preferably about 200 to 2,000. Esters are preferred and fatty acids containing from 10–30 carbon atoms are useful for reacting with the glycols to form the ester additives and it is preferred to use a $C_{18}$–$C_{24}$ fatty acid, especially behenic acids. The esters may also be prepared by esterifying polyethoxylated fatty acids or polyethoxylated alcohols.

Other suitable additives for fuel composition of this invention are ethylene unsaturated ester copolymer flow improvers. The unsaturated monomers which may be copolymerised with ethylene include unsaturated mono and diesters of the general formula:

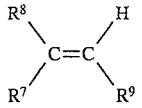

wherein $R^8$ is hydrogen or methyl, $R^7$ is a —$OOCR^{10}$ group wherein $R^{10}$ is hydrogen or a $C_1$ to $C_{28}$, more usually $C_1$ to $C_{17}$, and preferably a $C_1$ to $C_8$, straight or branched chain alkyl group; or $R^7$ alkyl is a —$COOR^{10}$ group wherein $R^{10}$ is as previously defined but is not hydrogen and $R^9$ is hydrogen or —$COOR^{10}$ as previously defined. The monomer, when $R^7$ and $R^9$ are hydrogen and $R^8$ is —$OOCR^{10}$ includes vinyl alcohol esters of $C_1$ to $C_{29}$, more usually $C_1$ to $C_{18}$, monocarboxylic acid, and preferably $C_2$ to $C_{29}$, more usually $C_1$ to $C_{18}$, monocarboxylic acid, and preferably $C_2$ to $C_5$ monocarboxylic acid. Examples of vinyl esters which may be copolymerised with ethylene include vinyl acetate, vinyl propionate and vinyl butyrate or isobutyrate, vinyl acetate being preferred. It is preferred that the copolymers contain from 1.0 to 40 wt % of the vinyl ester, more preferably from 25 to 35 wt % vinyl ester. They may also be mixtures of two copolymers such as those described in U.S. Pat. No. 3,961,916. It is preferred that these copolymers have a number average molecular weight as measured by vapour phase osmometry of 1000 to 6,000, preferably 1,000 to 4000.

Other suitable additives fuel compositions of the present invention are polar compounds, either ionic or non-ionic, which have the capability in fuels of acting as wax crystal growth inhibitors. Polar nitrogen containing compounds have been found to be especially effective when used in combination with the glycol esters, ethers or ester/ethers. These polar compounds are generally amine salts and/or amides formed by reaction of at least one molar proportion of hydrocarbyl substituted amines with a molar proportion of hydrocarbyl acid having 1 to 4 carboxylic acid groups or their anhydrides; ester/amides may also be used containing 30 to 300, preferably 50 to 150 total carbon atoms. These nitrogen compounds are described in U.S. Pat. No. 4,211,534. Suitable amines are usually long chain $C_{12}$–$C_{40}$ primary, secondary, tertiary or quaternary amines or mixtures thereof but shorter chain amines may be used provided the resulting nitrogen compound is oil soluble and therefore normally containing about 30 to 300 total carbon atoms. The nitrogen compound preferably contains at least one straight chain $C_8$–$C_{40}$, preferably $C_{14}$ to $C_{24}$ alkyl segment.

Suitable amines include primary, secondary, tertiary or quaternary, but preferably are secondary. Tertiary and quaternary amines can only form amine salts. Examples of amines include tetradecyl amine, cocoamine, hydrogenated tallow amine and the like. Examples of secondary amines include dioctacedyl amine, methyl-behenyl amine and the like. Amine mixtures are also suitable and many amines derived from natural materials are mixtures. The preferred amine is a secondary hydrogenated tallow amine of the formula $HNR_1R_2$ wherein $R_1$ and $R_2$ are alkyl groups derived from hydrogenated tallow fat composed of approximately 4% $C_{14}$, 31% $C_{16}$, 59% $C_{18}$.

Examples of suitable carboxylic acids or their anhydrides for preparing these nitrogen compounds (and their anhydrides) include cyclohexane, 1,2 dicarboxylic acid, cyclohexene dicarboxylic acid, cyclopentane 1,2 dicarboxylic acid naphthalene dicarboxylic acid and the like. Generally, these acids will have about 5–13 carbon atoms in the cyclic moiety. Preferred acids are benzene dicarboxylic acids such as phthalic acid, tera-phthalic acid, and iso-phthalic acid. Phthalic acid or its anhydride is particularly preferred. The particularly preferred compound is the amide-amine salt formed by reacting 1 molar portion of phthalic anhydride with 2 molar portions of di-hydrogenated tallow amine. Another preferred compound is the diamide formed by dehydrating this amide-amine salt.

One or more of these co-additives may be used in combination with the additives of this invention.

The relative proportions of additives used in the mixtures are preferably from 0.05 to 20 parts by weight more preferably from 0.1 to 5 parts by weight of the itaconate or citraconate polymer to 1 part of the other additives such as the polyoxyalkylene esters, ether or ester/ether.

The amount of polymer (flow improver) added to the crude oil, lubricating oil or fuel oil is preferably 0.0001 to 5.0 wt %, for example, 0.001 to 0.5 wt % (active matter) based on the weight of crude oil, lubricating oil or fuel oil. Generally more will be used in a lubricating oil than in a fuel oil, e.g. 0.1 to 1.0 wt % compared with 0.01 to 0.05 wt % respectively.

The polymer may conveniently be dissolved in a suitable solvent to form a concentrate of from 20 to 90, e.g. 30 to 80 weight % polymer in the solvent. Suitable solvents include kerosene, aromatic naphthas, mineral lubricating oils etc.

EXAMPLE

In this Example four copolymers (IVA) of a dialkyl itaconate and vinyl acetate (K, L, M and N) and four homopolymers (PI) of a dialkyl itaconate (A, B, C and D) were prepared and tested in the Cold Filter Plugging Point Test (CFPPT) and the Slow Cooling Test (SCT).

The four homopolymers were those of n-decyl itaconate (A), n-dodecyl itaconate (B), n-tetradecyl itaconate (C) and di-n-hexadecyl itaconate (D) and each had $M_n$'s of about 30,000 and $M_w$'s of about 70,000.

The four copolymers were those of vinyl acetate and respectively di-n-decyl itaconate (K), di-n-dodecyl itaconate (L), di-n-tetradecyl itaconate (M) and di-n-hexadecyl itaconate (N) each having, $M_n$'s of about 20,000 and $M_w$'s of about 60,000 as measured by gel permeation chromatography relative to polystyrene standard, the mole ratios of vinyl acetate to itaconate being 1.0:1.0.

The four copolymers and the four homopolymers were prepared by polymerising the monomers in a cyclohexane solvent using catalysts such as azo-iso his butyronitrite, di-t-butyl peroxide or t-butyl peroctoate and refluxing. For the copolymers the mole ratio of itaconate to vinyl acetate was 1:1.

The copolymers and homopolymers were then added to diesel fuels having the following characteristics:

| Fuel | Wax Appearance Point | Cloud Point | D 86 Distillation (°C.) IBP | 20 | 50 | 90 | FBP |
|---|---|---|---|---|---|---|---|
| I | 1° C. | +3° C. | 184 | 226 | 272 | 368 | 398 |
| II | −9° C. | −6° C. | 170 | 228 | | 316 | 347 |
| III | −15° C. | −12° C. | 159 | 210 | | 316 | 350 |
| IV | −10° C. | −10° C. | 168 | 231 | | 325 | 350 |
| V | −1.5° C. | 3° C. | 184 | 223 | 267 | 367 | 398 |
| VI | −3.5° C. | 0° C. | 166 | 211 | 251 | 334 | 376 |

Also each of the copolymers and homopolymers were blended in various weight ratios (active matter) with a 3:1 weight mixture of (A) an ethylene-vinyl acetate copolymer having a vinyl acetate weight content (by 500 MHz NMR)

of 36%, a number average molecular weight of 2000 and a degree of side chain branching methyls/100 methylenes (by 500 MHz NMR) of 4 and (B) an ethylene-vinyl acetate copolymer having a vinyl acetate weight content by 500 (MHz NMR) of 17%, a number average molecular weight of 3,500 and a degree of side chain branching methyls/100 methylenes (by 500 MHz NMR) of 8. Each of these six blends were also added to the diesel fuel oil in a concentration (active matter) of 300 ppm (0.03 wt %) for the blend as a whole.

The results achieved are shown in the following Table as determined by the CFPPT and the SCT, details of which test given below.

THE COLD FILTER PLUGGING POINT TEST (CFPPT)

The cold flow properties of the blend were determined by the Cold Filter Plugging Point Test (CFPPT). This test is carried out by the procedure described in detail in "Journal of the Institute of Petroleum", Vol. 52, No. 510, June 1966 pp. 173–185. In brief, a 40 ml. sample of the oil to be tested is cooled by a bath maintained at about 34° C. Periodically (at each one degree Centigrade drop in temperature starting from 2° C. above the cloud point) the cooled oil is tested for its ability to flow through a fine screen in a time period. This cold property is tested with a device consisting of a pipette to whose lower end is attached an inverted funnel positioned below the surface of the oil to be tested. Stretched across the mouth of the funnel is a 350 mesh screen having an area of about 0.45 square inch. The periodic tests are each initiated by applying a vacuum to the upper end of the pipette whereby oil is drawn through the screen up into the pipette to a mark indicating 20 ml. of oil. The test is repeated with each one degree drop in temperature until the oil fails to fill the pipette within 60 seconds. The results of the test are quoted as Δ CFPPT (°C.) which is the difference between the fail temperature of the untreated fuel ($CFPP_0$) and the fuel treated with the itaconate polymer ($CFPP_1$) i.e. ° $\Delta CFPP = CFPP_0 - CFPP_1$.

PROGRAMMED COOLING TEST (PCT)

This is a slow cooling test designed to correlate with the pumping of a stored heating oil. The cold flow properties of the described fuels containing the additives are determined by the SCT as follows. 300 ml of fuel are cooled linearly at 1° C./hour to the test temperature from a temperature at least 5° C. above its Cloud Point and the temperature then held constant. After 2 hours at the test temperature, approximately 20 ml of the surface layer is removed by suction to prevent the test being influenced by the abnormally large wax crystals which tend to form on the oil/air interface during cooling. Wax which has settled in the bottle is dispersed by gentle stirring, then a CFPPT filter assembly is inserted. The tap is opened to apply a vacuum of 500 mm of mercury, and closed when 200 ml of fuel have passed through the filter into the graduated receiver: A PASS is recorded if the 200 ml are collected within ten seconds through a given mesh size of a fail if the flow rate is too slow indicating that the filter has become blocked.

The mesh number passed at the test temperature is recorded.

CLOUD POINT DEPRESSION

Depression of the Cloud Point (IP-219 or ASTM-D 2500) of a distillate fuel is often desireable. The effectiveness of the additives of the present invention in lowering the cloud point of distillate fuels was determined by the standard Cloud Point Test (IP-219 or ASTM-D 2500) other more accurate measures of the onset of crystallisation are the Wax Appearance Point (WAP) Test ASTM D.3117-72) and the Wax Appearance Temperature (WAT) as measured by different scanning calorimetry using a Mettler TA 2000B differential scanning calorimeter. In the test a 25 microliter sample of the fuel is cooled at 2° C./min. from a temperature at least 30° C. above the expected cloud point of the fuel. The observed onset of crystallisation is estimated, without correction for thermal lag (approximately 2° C.), as the wax appearance temperature as indicated by the differential scanning calorimeter. The results of the test are quoted as WAT (°C.) which is the difference between the WAT of the base, untreated fuel ($WAT_0$) and the WAT of the fuel treated with additives, ($WAT_1$), i.e. $WAT = WAT_0 - WAT_1$.

TABLE 1

| Additive | Treat (ppm) | ΔWAT | PCT (Mesh No) at −8° C. | ΔPP (°C.) |
|---|---|---|---|---|
| A | 175 | 0 | 100 | |
| | 300 | 1 | 100 | 0.0 |
| A + X | 35/140 | 14 | 250 | |
| | 60/240 | 19 | 250 | |
| B | 175 | 1 | 100 | |
| | 300 | 2 | 100 | 0.0 |
| B + X | 35/140 | 15 | 250 | |
| | 60/240 | 18 | 250 | |
| C | 175 | 4 | 100 | |
| | 300 | 9 | 100 | 1.5 |
| C + X | 35/140 | 20 | 350 | |
| | 60/240 | 22 | 350 | |
| D | 175 | 2 | 60 | |
| | 300 | 6 | 60 | 5.4 |
| D + X | 35/140 | 12 | 100 | |
| | 60/240 | 12 | 150 | |
| K | 175 | 1 | 120 | |
| | 300 | 2 | 150 | 0.1 |
| K + X | 35/140 | 2 | 250 | |
| | 60/240 | 5 | 250 | |
| L | 175 | 1 | 150 | |
| | 300 | 1 | 200 | 0.1 |
| L + X | 35/140 | 3 | 350 | |
| | 60/240 | 5 | 350 | |
| M | 175 | 2 | 250 | |
| | 300 | 4 | 350 | 1.6 |
| M + X | 35/140 | 19 | 150 | |
| | 60/240 | 20 | 200 | |
| N | 175 | 1 | 60 | |
| | 300 | 4 | 60 | 4.4 |
| N + X | 35/140 | 13 | 120 | |
| | 60/240 | 15 | 150 | |
| X | 175 | 3 | 100 | |
| | 300 | 4 | 150 | −0.4 |
| None | — | — | 40 | |

From Table 1 it can be seen that good results are achieved by additives A, B, C, K, L and M above and in combination with X which are better than no additive at all or X alone.

In the further Examples Polymer Y is a fumarate-vinyl acetate copolymer made from an equimolar mixture of di-n-hexadecyl fumarate and vinyl acetate in cyclohexane as solvent. The catalyst was t-butyl peroctoate.

The results of testing the Additives in Fuel V are set out in Tables 2 to 4.

TABLE 2

| Additive | Treat (ppm) | WAT °C. | °C. CFPP |
|---|---|---|---|
| K | 500 | −2.3 | −3, |
| K + X | 500/200 | +0.1 | −6, |

TABLE 2-continued

| Additive | Treat (ppm) | WAT °C. | °C. CFPP |
|---|---|---|---|
| L | 500 | −2.5 | −3, |
| L + X | 500/200 | +0.3 | −9, |
| M | 500 | −2.3 | −9, |
| M + X | 500/200 | −1.2 | −17, |
| N | 500 | −3.9 | −7, |
| N + X | 500/200 | −1.9 | −9, |
| A | 500 | 0.0 | −3, |
| A + X | 500/200 | +0.5 | −9, |
| B | 500 | +0.4 | −3, |
| B + X | 500/200 | +0.6 | −16, |
| C | 500 | −1.2 | −7, |
| C + X | 500/200 | −0.5 | −18, |
| D | 500 | −4.6 | −7, |
| D + X | 500/200 | −4.0 | −9, |
| Base | | −0.6 | −3, |
| X | 200 | +0.5 | −15, |

WATS measured using a Du Pont 990 DSC with a 10 ul sample and a 10° C. cooling rate.
CFPP Regression = $CFPP_{X + \text{Itaconate Polymer} - CFPPX}$

TABLE 3

| Additive | Treat (ppm) | WAT In FUEL V (°C.) | WAT In FUEL VI (°C.) |
|---|---|---|---|
| N | 500 | 3.3 | 3.5 |
| D | 500 | 4.0 | 4.1 |
| Y | 500 | 3.0 | 3.1 |

TABLE 4

| | | WAT (°C.) in FUEL: | | |
|---|---|---|---|---|
| Additive | Treat (ppm) | II | III | IV |
| M | 500 | 1.5 | 2.5 | 3.5 |
| | 1000 | 2.0 | 4.0 | 4.0 |
| C | 500 | 1.0 | 2.0 | 3.0 |
| | 1000 | 2.0 | 3.5 | 3.0 |

TABLE 4-continued

| | | WAT (°C.) in FUEL: | | |
|---|---|---|---|---|
| Additive | Treat (ppm) | II | III | IV |
| B | 500 | 0.0 | −0.5 | 1.5 |
| | 1000 | 0.0 | 0.5 | 1.0 |

We claim:

1. A composition consisting of a major proportion by weight of a fuel oil and 0.0001 to 5 wt. % by weight of a itaconate or citraconate homopolymer flow improver additive containing the repeating units:

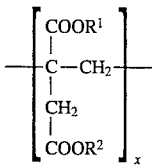

or

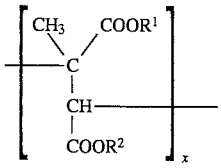

wherein x is an integer and $R^1$ and $R^2$ represent a C10–C30 alkyl and the polymer has a molecular weight of 1,000 to 500,000.

2. The composition of claim 1 wherein $R^1$ and $R^2$ are $C_{12}$–$C_{16}$ alkyl groups and the fuel oil is a middle distillate.

3. The composition of claim 1 wherein $R^1$ and $R^2$ are $C_{16}$–$C_{22}$ alkyl groups and the fuel oil is a heavy fuel oil.

* * * * *